United States Patent [19]

Srock et al.

[11] 4,138,513

[45] Feb. 6, 1979

[54] PROCESS FOR SURFACE PAINTING OF BODY PARTS FOR MOTOR VEHICLES CONSISTING OF SYNTHETIC PLASTIC MATERIAL

[75] Inventors: Rainer Srock, Leinfelden; Hermann Ziegler, Renningen, both of Fed. Rep. of Germany

[73] Assignee: Dr. Ing. h.c.F. Porsche Aktiengesellschaft, Fed. Rep. of Germany

[21] Appl. No.: 742,667

[22] Filed: Nov. 17, 1976

[30] Foreign Application Priority Data

Nov. 28, 1975 [DE] Fed. Rep. of Germany ..... 2553482

[51] Int. Cl.[2] ..... B05D 1/38; B05D 3/12; B05D 7/02

[52] U.S. Cl. ..... 427/371; 427/379

[58] Field of Search ..... 427/371, 379; 428/414

[56] References Cited

U.S. PATENT DOCUMENTS

| | | | |
|---|---|---|---|
| 3,177,090 | 4/1965 | Bayes et al. | 428/414 |
| 3,508,951 | 4/1970 | Shimp et al. | 428/414 |

*Primary Examiner*—James R. Hoffman

*Attorney, Agent, or Firm*—Craig & Antonelli

[57] ABSTRACT

A method for surface painting body parts for motor vehicles consisting of synthetic resinous material, in which a first layer consisting of a filler preferably including two components is applied onto the body part and is thereafter baked-in; this first layer is then fine-finished to obtain a smooth surface; thereafter an intermediate filler is applied and baked-in over the first layer, which is then again fine-finished, and finally a cover paint is applied as third layer which is again baked-in.

12 Claims, No Drawings

PROCESS FOR SURFACE PAINTING OF BODY PARTS FOR MOTOR VEHICLES CONSISTING OF SYNTHETIC PLASTIC MATERIAL

The present invention relates to a method for the surface painting of body parts consisting of synthetic plastic material for motor vehicles.

It is known in the art to paint body parts—for example, bumpers—of the aforementioned type of a different color than the remaining body of steel sheet-metal, in order to avoid disturbing color changes which might result in the course of time.

It is the aim of the present invention to provide a process, by means of which the body parts of synthetic plastic material can be painted with the same color as the remaining body, for example, of sheet-metal steel, without the danger that annoying or disturbing color differences will result in the course of time. The underlying problems are solved according to the present invention by the following method steps for a surface painting:

(a) A filler preferably comprising two components is applied onto the body part and is thereafter baked-in by conventional means;

(b) This first layer is fine-finished by means of subsequent grinding operation;

(c) An intermediate filler is thereupon applied onto this layer and is baked-in;

(d) The second layer is fine-finished by means of subsequent grinding operation;

(e) Finally, a cover paint or lacquer is applied as third coating which is again baked-in.

In one embodiment, the first layer is baked-in for about sixty minutes at a temperature of about 80° C. The second layer is baked-in for about 15 minutes at a temperature of about 160° C. The third layer is baked-in for about 30 minutes at a temperature of about 130° C.

The particular advantages achieved with the present invention reside in that a surface painting for body parts of synthetic resinous material, especially of fiber-glass reinforced polyester resins, is achieved by the described method, by means of which not only a generally good surface quality of the paint is obtained but also that these body parts of synthetic resinous material can be painted of the same color as the remaining body parts consisting of steel sheet-metal panels, without the danger that annoying color differences between the body and the parts of synthetic resinous material will result over longer periods of time.

The method according to the present invention can be used advantageously with hot-pressed or hot-extruded GFK parts with the use of the following steps:

A GFK part, for example, a bumper, which is a part hot-pressed in heated work tools consisting of a mandrel and of a matrix, in which the material fed thereto is being formed in liquid condition and at a relatively high pressure, is provided on its surfaces with a two-component filler on polyurethane basis which is applied by spraying and is thereafter baked-in for about sixty minutes at a temperature of about 80° C. Subsequently thereto, with the use of suitable emery or sanding paper (fine grain), this coating is subjected to a grinding or sanding fine-finish operation to obtain a smooth finish. Thereupon, an intermediate filler, preferably on the basis of alkyd-melamine is applied on the bumper by spraying and is baked-in for about 15 minutes at about 160° C. This layer is now also subjected to a grinding or sanding fine-finish operation with the use of a fine-grain emery or sanding paper. Finally, a cover paint or lacquer is applied on the bumper again by spraying which is baked-in for about thirty minutes at a temperature of 130° C. The cover paint or lacquer is based either on alkyd-melamine or on other conventional substances possessing good cover properties as known in the art. Conventional spraying techniques may be used for applying the various coatings and layers of the method in accordance with the present invention.

The cover paint and second (intermediate) filler correspond to the compositions which are conventionally used in most motor vehicle painting processes for painting steel sheet-metal panel parts and are based on alkyd-melamine compositions. Only the two component filler is based on an epoxy resin of conventional type.

The fine-finish of the first and second layers is achieved, for example, by the use of an emery or sanding paper with a grain size of about 240 to about 600 mesh in conjunction with conventional tools.

For example, bumpers, displaceable or removable roofs, hoods, etc. of synthetic resinous material, especially of conventional glass-fiber reinforced polyester resins, can be painted by the process in accordance with the present invention.

It is, of course, understood that the time periods and temperatures indicated above are only one typical example of the present invention but may be so varied within fairly wide limits that starting with the values indicated hereinabove, a shorter period of time is required at higher temperatures or vice versa.

While we have described only one embodiment in accordance with the present invention, it is understood that the same is not limited thereto but is susceptible of numerous changes and modifications as known to those skilled in the art.

We claim:

1. A method for surface painting body parts of motor vehicles, wherein said body parts consist of synthetic plastic material, said method comprising the steps of:

(a) applying onto a body part a first layer of a filler comprising an epoxy resin and baking-in said first layer for about 60 minutes at about 80° C.;

(b) sanding the surface of said first layer to fine-finish the same;

(c) applying on the fine-finish first layer a second layer of an intermediate filler comprising an alkyd-melamine resin and baking-in said intermediate filler for about 15 minutes at a temperature of about 160° C.;

(d) sanding the surface of said second layer to fine-finish same; and (e) applying as a third layer a cover paint comprising an alkyd-melamine resin and baking-in said third layer for about 30 minutes at a temperature of about 130° C.

2. A method according to claim 1, wherein the sanding is effected with a sanding or emery paper with a grain size of about 240 to about 600 mesh.

3. A method according to claim 1, wherein the filler of the first layer is a two-component filler comprised of an epoxy resin.

4. A method according to claim 3, wherein the first layer is baked-in for about sixty minutes at about 80° C.

5. A method according to claim 3, wherein the second layer is baked-in for about 15 minutes at a temperature of about 160° C.

6. A method according to claim 3, wherein the third layer is baked-in for about 30 minutes at a temperature of about 130° C.

7. A method according to claim 3, wherein the second and third layers are comprised of an alkyd-melamine resin while the first layer is a two-component filler comprised of an epoxy resin.

8. A method for surface painting a fiber-glass reinforced resin body part of a motor vehicle, comprising the steps of (a) applying a two-component filler comprised of an epoxy resin onto a fiber-glass reinforced polyester resin body part and baking-in said filler;

(b) fine-finishing the epoxy resin-filled surface of the polyester resin body part of step (a);

(c) applying an intermediate filler comprised of an alkyd-melamine resin onto the fine-finished body part surface of step (b) and baking-in said intermediate filler;

(d) fine-finishing the alkyd-melamine resin-filled surface of the polyester resin body part of step (c); and (e) applying a cover paint or lacquer onto the fine-finished body part of step (d) and baking-in said cover paint or lacquer.

9. A method according to claim 8, wherein said fine-finishing of steps (b) and (d) is effected with sanding or emery paper with a grain size of about 240 to about 600 mesh.

10. A method according to claim 8, wherein said baking-in according to step (a) is for about 60 minutes at a temperature about 80° C.

11. A method according to claim 8, wherein said baking-in according to step (c) is for about 15 minutes at a temperature about 160° C.

12. A method according to claim 8, wherein said baking-in according to step (e) is for about 30 minutes at a temperature about 130° C.

* * * * *